United States Patent [19]

Wiberg

[11] 3,969,916

[45] July 20, 1976

[54] ISOSTATIC PRESS

[75] Inventor: Robert Wiberg, Ystad, Sweden

[73] Assignee: AB Carbox, Ystad, Sweden

[22] Filed: May 20, 1975

[21] Appl. No.: 579,248

[30] Foreign Application Priority Data

June 10, 1974 Sweden ..... 7407649

[52] U.S. Cl. ..... 72/56; 72/257; 72/272

[51] Int. Cl.[2] ..... B21D 26/04; B21C 35/00

[58] Field of Search ..... 72/60, 58, 56, 54, 57, 72/257, 272

[56] References Cited

UNITED STATES PATENTS 3,127,013 3/1964 Dohrn ..... 72/272 X 3,531,965 10/1970 Nilsson ..... 72/60

*Primary Examiner*—Milton S. Mehr

*Attorney, Agent, or Firm*—Flynn & Frishauf

[57] ABSTRACT

An isostatic press of the kind having a pressure vessel which is relatively tall in relation to its width, the pressure vessel being adapted to be closed by a lid in order to enclose workpieces and tools together with a pressure fluid in said vessel. The pressure fluid is adapted to be pressurized after the pressure vessel has been introduced into a frame adapted to absorb forces substantially in the longitudinal direction of the vessel. The pressure vessel is disposed pivotally in relation to the frame and means are provided to produce a pivoting movement between the vessel and the frame such as to give access to the top end of the vessel.

6 Claims, 2 Drawing Figures

ISOSTATIC PRESS

This invention relates to an isostatic press, especially of the kind comprising a pressure vessel which is relatively tall in relation to its width, said vessel being adapted to be closed by means of a lid in order to enclose the workpieces and tools together with a pressure fluid in said vessel, the pressure fluid being intended to be pressurised after the pressure vessel has been introduced into a frame adapted to absorb forces substantially in the longitudinal direction of the vessel.

Known isostatic presses can be divided into two main types, in one of which the pressure vessel is constructed in the form of a cylinder, the two ends of which are adapted to be closed by means of lids adapted to be screwed into the cylinder, said lids having seals. This type is very simple to produce and is suitable for applications requiring only relatively small highpressure vessels. In the case of larger vessels and increasing diameters, the tensile stresses in the screwthreads and cylinder are so great that the lid and bottom should be held in place by external means. An external frame is used for this purpose and is adapted to receive a cylindrical pressure vessel, the lid and bottom of which are adapted to be introduced axially into the cylinder. This type reduces the risks in the case of larger pressure vessels, but it does have certain disadvantages, inter alia concerning access to the pressure vessel for charging purposes.

In a known arrangement, this has been solved by arranging the cylindrical pressure vessel so that it can be introduced into and withdrawn from the frame by means of a carriage. Inter alia, this requires special means to avoid subjecting the wheels and axles of the carriage to the large forces occurring when the vessel is pressurised. If the pressure vessels used are tall in relation to their width, it is also difficult to achieve the stability required on moving it on a carriage. Elongated vessels are very common, since the cost of a given volume of a highpressure vessel decreases with decreasing vessel width. A typical ratio between length and width is 4:1. In another known arrangement the cylinder is fixed and the frame is movable in relation to the cylinder. An arrangement of this kind may be practical for relatively small frames, but it necessarily becomes expensive and complicated in the case of the heavy frame weights of several hundred tons sometimes required.

The main object of the invention is to provide a simple isostatic press especially of the kind having an elongated pressure vessel, which can be manufactured at a low cost and which eliminates the above disadvantages of known presses.

SUMMARY OF THE INVENTION

To this end, according to the invention, the purely translatory movement between the frame and the cylinder is replaced by a pivoting movement between them. To this end, the pressure vessel and the frame are pivotally interconnected at the bottom end of the pressure vessel. A relative pivoting movement between the vessel and the frame about the said point provides access to the opening in the top end of the vessel without the pressure vessel and frame needing to be removed from one another. Advantageously, the lid is mounted in the frame and is moveable in the longitudinal direction thereof. To allow the said movement and achieve a power-transmitting connection between the lid and the frame when the fluid is in the vessel is pressurised, laterally displaceable spacer elements are used which can be introduced between the said lid and the frame. The frame is advantageously fixed at a certain angle to the vertical line, the cylinder being disposed pivotally in relation to the frame. Advantageously, the said angle is so selected that the cylinder in the swung-out position assumes a vertical position or else is so selected that the cylinder in the swung-out position forms the same angle to the vertical line as the frame.

The characteristic features of the invention will be apparent from the claims.

BRIEF DESCRIPTION OF THE DRAWINGS

The invention will be described in detail below with reference to a preferred embodiment illustrated in the accompanying drawings wherein.

DETAILED DESCRIPTION OF ILLUSTRATED EMBODIMENT

Figure 1:
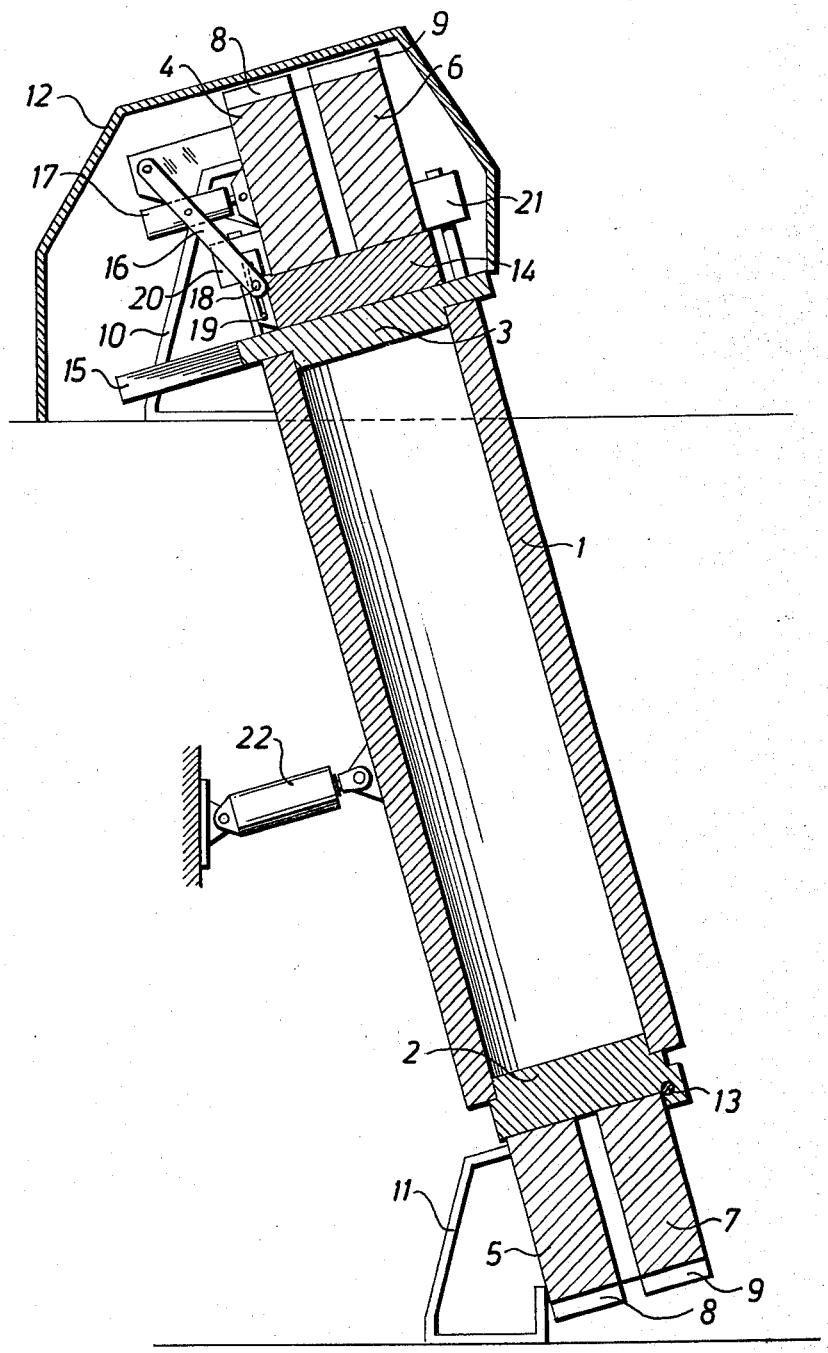
FIG. 1 is a section through an isostatic press acccording to the invention showing the pressure vessel swung into the frame.

The isostatic press shown in the drawings comprises an elongated cylindrical high-pressure vessel 1 having a bottom closure 2 and a top lid 3 which can be axially pushed into the cylinder 1 a predetermined amount. In FIG. 1 the pressure vessel 1 is pivoted into a frame primarily adapted to absorb the axial forces occurring when a fluid introduced into the vessel is pressurised to act upon workpieces or the like immersed in the fluid. In the embodiment illustrated, the frame comprises two parallel units each having its own pair of end yokes 4, 5; 6, 7 respectively and columns therebetween, each unit being pressed together by means of tension biased wire bandages 8, 9 respectively comprising pretensioned wires or strips. The frame is supported by two yoke-shaped holders 10, 11 respectively situated, for example, at different floor levels. The top part of the press is surrounded by a protective casing 12. The pressure vessel 1 is pivotally connected to the frame via a pivot 13 disposed in the bottom closure 2. A spacer plate 14 is provided between the top lid 3 and the upper yokes 4, 6 of the frame. The plate 14 can be laterally displaced along a track 15 flush with the lid 3, by means of a lever arm 16 operable by means of a double-acting hydraulic cylinder 17. Lever arm 16 is connected to plate 14 via an end pin 18 cooperating with a groove 19 formed in a panel mounted on the plate. Reference numerals 20 and 21 denote two double-acting hydraulic cylinders adapted to displace the top lid 3 in the longitudinal direction of the stand while reference 22 denotes also a double-acting hydraulic cylinder for pivoting the cylinder 1 between the positions shown in FIGS. 1 and 2.

As already stated, FIG. 1 shows the pressure vessel 1 in the position it occupies when a fluid therein is to be subjected to high pressure, for example to form or compact material enclosed in the vessel. To facilitate the removal of finished workpieces from, and the introduction of new workpieces into, the vessel 1, the top end of the latter can be pivoted out of the frame as shown in FIG. 2.

Figure 2:
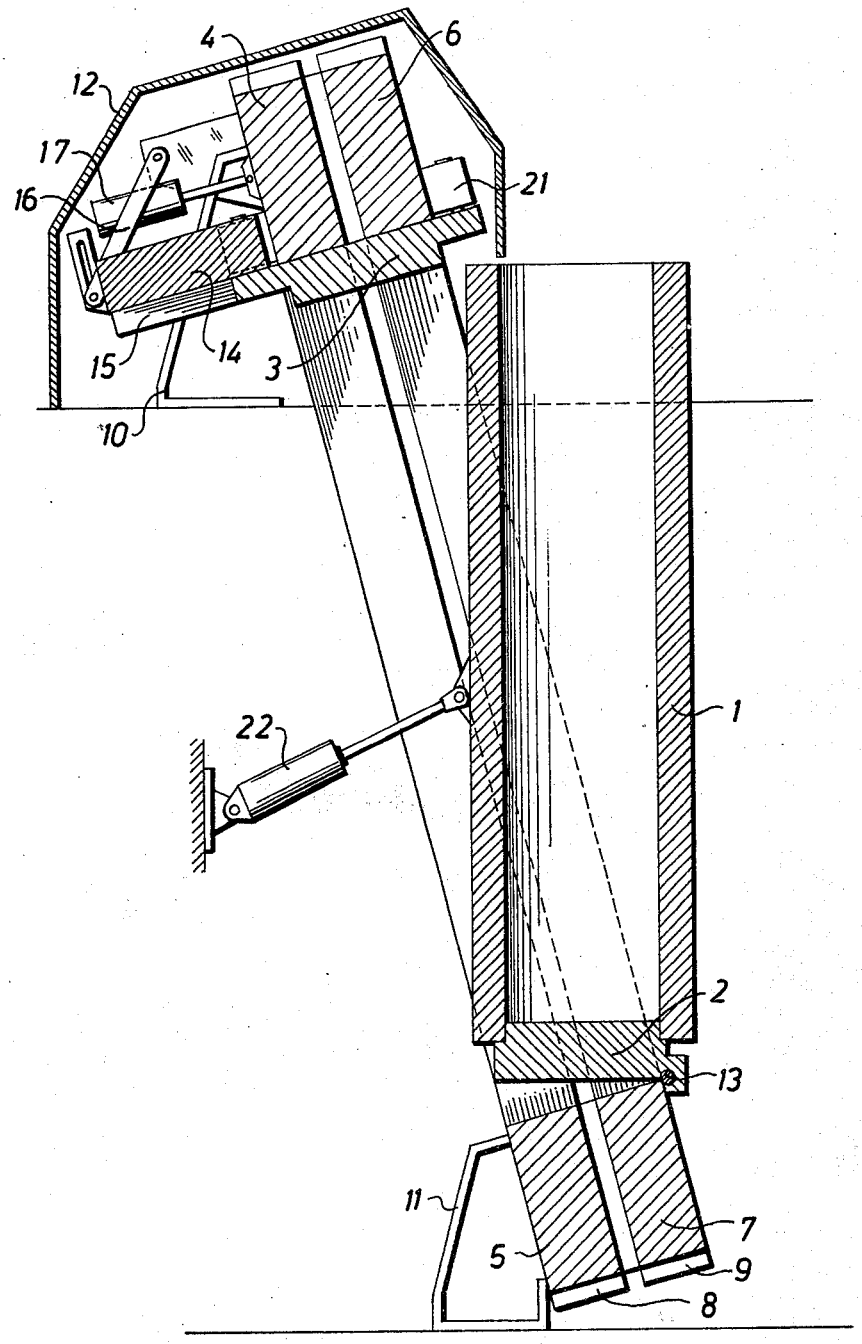
FIG. 2 is a corresponding section to FIG. 1 with the pressure vessel in the swung-out position.

To pivot the vessel into the position shown in FIG. 2, the spacer plate 14 is first withdrawn laterally by means of the lever arm 16. This operation is facilitated because after a pressing operation the top lid 3 can be pressed back down into the cylinder for a short distance, the spacer plate being released. After the plate 14 has been withdrawn so it rests on the track 15, the top lid 3 is withdrawn from the cylinder 1 by means of the hydraulic cylinders 20, 21. The lid 3 together with the track 15 and the plate 14 will then occupy the positions shown in FIG. 2, in which the top end of the cylindrical vessel 1 can be pivoted out of the frame by means of the hydraulic cylinder 22. After the vessel has been swung out in this way, it is immediately accessible for the removal or introduction of workpieces and tools, since the top lid is retained in the frame. This greatly simplifies operation of the press system, since a number of stages of operation are thus eliminated, so that the system can be utilised more effectively. In known equipments, the connection of the fluid pipe to the lid (not shown in the drawings) first has to be released, and then the lid has to be lifted in a separate operation. The release of the said connection for each working cycle also entails the risk of damage to the accurate sealing of such connection — a very serious occurrence since the fluid pressure used is very high and may, for example, be in excess of 2000 bars.

The reverse procedure is used to pivot the pressure cylinder into the frame. When the longitudinal axis of the cylinder has assumed the same direction as the longitudinal axis of the frame, the top lid 3 is first introduced into the top end of the cylinder by means of the hydraulic cylinders 20, 21, and then the spacer plate 14 is pushed in between the lid and the top yokes of the frame by means of the lever arm 16 and the hydraulic cylinder 17. The spacer plate 14 thus forms an essential element in the embodiment illustrated, since its use is a simple way of providing a space allowing sufficient movement of the lid 1, when the latter is mounted in the frame, to enable the cylinder to pivot out.

In the embodiment illustrated, the frame is at such an angle to the vertical line that the longitudinal axis of the cylinder in its swung-out position coincides with the vertical line. This facilitates introduction and removal of workpieces and tools into and out of the cylinder. To minimise the dead space in the cylinder, i.e. the space which cannot be filled with fluid before the lid is fitted to the cylinder, the frame may be disposed at such an angle to the vertical line that the longitudinal axis of the cylinder in the swung-out position forms the same angle to the vertical line as the longitudinal axis of the frame, i.e., the vertical line will bisect the angle between the longitudinal axes of the frame and cylinder when the cylinder is in the swung-out position. The frame can, however, form any other angle to the vertical line and also be disposed in line therewith. In an alternative embodiment, the cylinder may be fixed in a certain angular position and the frame be pivotable in relation to the cylinder. If the cylinder is disposed vertically in these conditions it can be filled with fluid to the required level without any risk of any fluid running out. Otherwise it is a general rule that the narrower the cylinder is, the smaller the volume of fluid to be supplied after the lid has been fitted.

The invention is not limited to the above-described embodiments, but can be modified in various respects within the scope of the claims, the essential feature being that a relative pivoting movement is used between the vessel and the frame instead of a purely translatory movement. This principle can also be applied to systems wherein the lid is not mounted in the frame.

What is claimed is:

1. An isostatic press, comprising:

a frame for receiving a pressure vessel which is relatively tall in relation to its width, said pressure vessel including a movable lid for closing the vessel to enclose workpieces and tools together with a pressure fluid in said vessel, the pressure fluid being pressurized after the pressure vessel has been introduced into the frame, said frame absorbing forces substantially in the longitudinal direction of the vessel;

pivot means for pivotally coupling said frame and the pressure vessel in relation to one another; and means for producing a relative pivoting movement between said frame and the pressure vessel so as to give access to the top end of the pressure vessel.

2. A press according to claim 1, wherein said pivot means pivotally interconnects said frame and the pressure vessel, at the bottom end of the pressure vessel.

3. A press according to claim 1, wherein the lid is mounted in the frame and is movable in the longitudinal direction of the pressure vessel, and including means for interposing at least one spacer element between the lid and said frame before the pressure fluid in the pressure vessel is pressurized.

4. A press according to claim 1, wherein said frame is fixed at a predetermined angle of inclination to the vertical line and the pressure vessel pivotable in relation to said frame.

5. A press according to claim 4, wherein the longitudinal direction of the pressure vessel in the swung-out position coincides with the vertical line.

6. A press according to claim 4, wherein the pressure vessel in the swung-out position forms substantially the same angle to the vertical line as said frame does.

* * * * *